United States Patent [19]

Peavey

[11] 4,425,832

[45] Jan. 17, 1984

[54] ADJUSTABLE BRIDGE FOR MUSICAL INSTRUMENT

[75] Inventor: Hartley D. Peavey, Meridian, Miss.

[73] Assignee: Peavey Electronics Corp., Meridian, Miss.

[21] Appl. No.: 345,089

[22] Filed: Feb. 2, 1982

[51] Int. Cl.[3] ..... G10D 3/04

[52] U.S. Cl. ..... 84/298; 84/307

[58] Field of Search ..... 84/298, 299, 307

[56] References Cited

U.S. PATENT DOCUMENTS

| | | | |
|---|---|---|---|
| 490,213 | 1/1893 | Owen et al. | 84/299 |
| 490,528 | 1/1893 | Wooster | 84/298 |
| 566,835 | 9/1896 | Ahlstrand | 84/299 |

FOREIGN PATENT DOCUMENTS

| | | | |
|---|---|---|---|
| 23567 | 9/1949 | Finland | 84/307 |

*Primary Examiner*—Lawrence R. Franklin

*Attorney, Agent, or Firm*—Berman, Aisenberg & Platt

[57] ABSTRACT

A bridge for a stringed musical instrument, particularly a guitar, is disclosed. The bridge is economical to manufacture, and may be made with simple punching and pressing operations. The bridge comprises a base which is secured to the instrument, and a saddle which is adjustably secured to the base. The saddle includes a lip which provides individual nodal points for the instrument's strings.

10 Claims, 5 Drawing Figures

FIG. 1
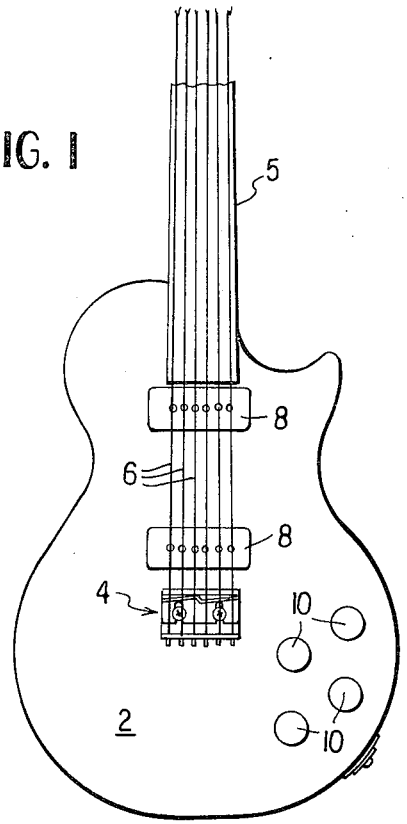
FIG. 2
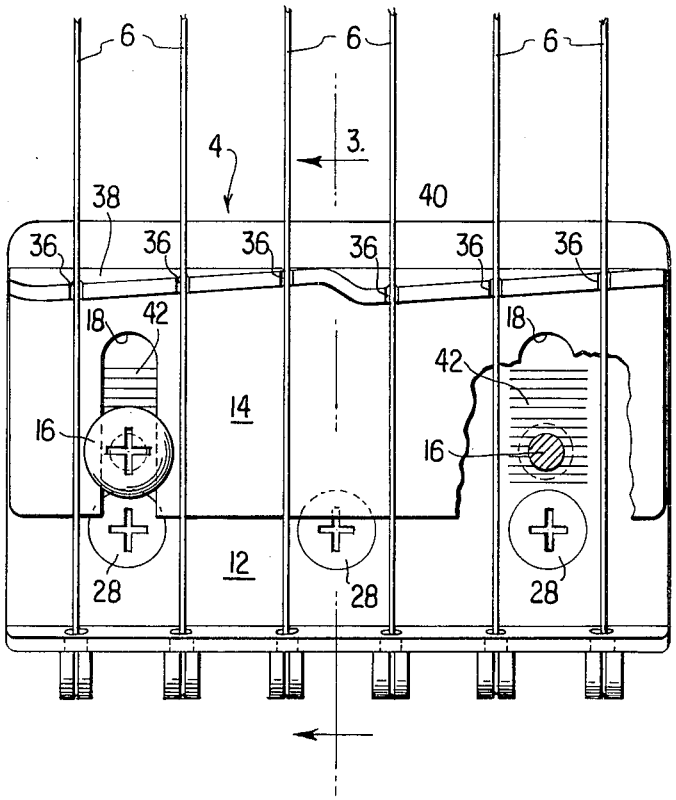
FIG. 3
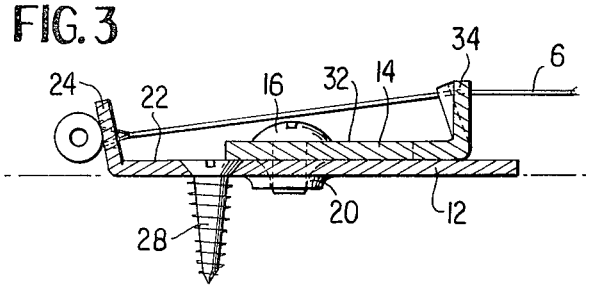
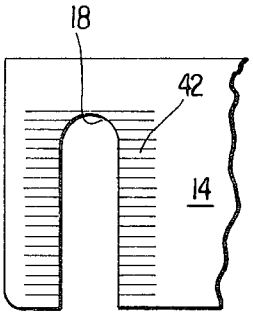
FIG. 4
FIG. 5
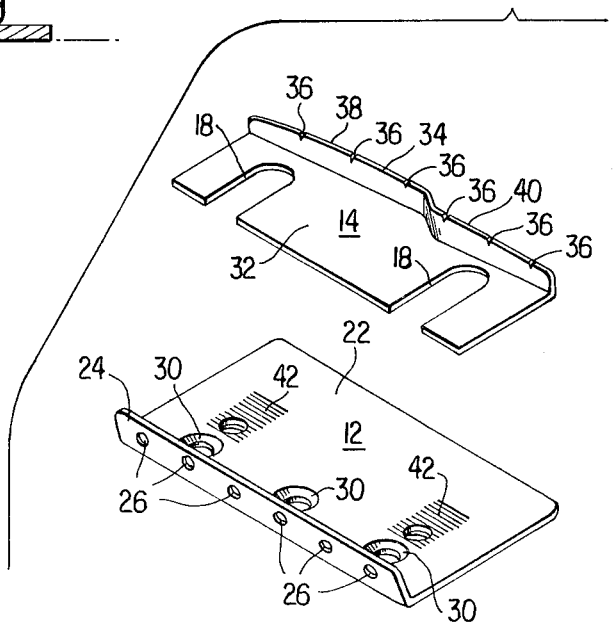

ADJUSTABLE BRIDGE FOR MUSICAL INSTRUMENT

TECHNICAL FIELD

The invention is a bridge for a musical instrument such as a guitar which secures the strings to the instrument and provides a separate nodal point for each of the strings.

BACKGROUND ART

Guitar bridges which are separate elements secured to the body of a guitar are known. The known guitar bridges are complicated and are difficult to manufacture since they have structures which must either be cast, or if pressed require a plurality of complicated and expensive pressing operations.

In U.S. Pat. No. 1,170,999 to Schultz there is shown a guitar bridge having two portions. One portion is secured to the guitar body and serves to secure the ends of the guitar strings. A second portion attaches to the first portion and serves as the nodal points for the strings. The second portion is adjustable in a vertical direction only and provides a single straight edge to serve as the nodal points. In U.S. Pat. No. 2,714,326 to McCarty, there is shown a guitar bridge which comprises a cylindrical-like element having holes for securing the ends of the guitar strings. The entire element is adjustable relative to posts which are fixed to the guitar body. U.S. Pat. No. 3,605,545 to Rendell shows a guitar bridge having a first portion fixed to the guitar body and a second movable element. The movable element is adjustable only in the vertical direction and rides in a slot provided in the first portion. The nodal points of the Rendell guitar bridge are provided by the movable element and are at different locations along the string for each string. U.S. Pat. No. 4,031,799 to Fender shows a guitar bridge having a base portion fixed to the guitar body for securing the ends of the guitar strings, and a plurality of nodal-elements secured to the base portion. The nodal-elements are cylinders which may be adjusted both vertically and in the direction of the guitar strings. U.S. Pat. No. 4,236,433 to Holland, shows a guitar bridge having a base portion fixed to the guitar body for securing the ends of the guitar strings and a plurality of nodal-elements which are adjustable along the directions of the guitar strings.

STATEMENT OF THE INVENTION

The bridge of the invention is a significant improvement of the prior art in that it is simple to manufacture and yet provides the advantages of nodal points for each of the strings which are at different respective locations along each of the strings, and for the adjustment of the location of the nodal points.

The bridge of the invention comprises two elements: a generally L-shaped baseplate, and a saddle which is also generally L-shaped. The baseplate includes a generally flat part which is fixed to the guitar and a second part which extends outwardly from the guitar. The second part of the baseplate is adapted to receive and secure the ends of the guitar strings. The saddle has a flat portion which mates with the flat part of the baseplate and has an outwardly extending portion which provides nodal points for the strings. The flat part of the baseplate and the flat portion of the saddle are secured to each other by means of screws which pass through the saddle and into the baseplate. The saddle has elongated grooves which extend in the direction of the guitar strings and which allow the saddle to be adjusted with respect to the baseplate in the direction of the guitar strings. In order to assist in securing the elements to each other there are provided gripping means on the top surface of the baseplate and on the bottom surface of the saddle.

The main advantage of the invention lies in its simplicity and ease of manufacture. The baseplate can be formed in two operations; one a punching operation and the second a bending operation. Similarly, the saddle can be formed with simple punching and bending operations. These two parts then need merely to be tumbled to remove the burrs and sharp edges, and the manufacturing process is complete. This results in an inexpensive manufacturing operation which produces a high quality bridge.

The second portion, or lip, of the saddle provides the desired nodal point positions. In general, the distances between the guitar nut and each of the nodal points should be different for each of the strings. This is necessary since each of the strings reacts differently when pressed against a fret. The saddle of the invention may be stamped so as to provide a separate nodal point location for each string.

BRIEF DESCRIPTION OF THE DRAWINGS

FIG. 1 is a body of a guitar showing the inventive guitar bridge.

FIG. 2 is a plan view of the inventive guitar bridge.

FIG. 3 is a cross section of the inventive guita bridge taken along line 3—3 of FIG. 2.

FIG. 4 is a portion of the underside of the saddle of the inventive guitar bridge.

FIG. 5 is an exploded diagram of the guitar bridge showing the two major elements.

DETAILED DESCRIPTION

FIG. 1 shows a guitar 2 having the inventive bridge 4. The bridge secures each of the strings 6 at one end of the string, while the other ends of the strings are secured by means on the neck 5 which is not shown. In addition to securing one end of each string, the bridge provides a nodal point for each of the strings. A nut (not shown) on the guitar neck 5 provides a second nodal point for each of the strings. The particular guitar shown in FIG. 1 provides for electronic amplification, and has sensors 8 and control knobs 10. The bridge of the invention may, however, be used with other stringed instruments.

The bridge of the invention includes a baseplate 12 and a saddle 14. The baseplate 12, more clearly seen in FIGS. 3 and 5, comprises a flat part 22 and a protruding part 24 and is thus generally L-shaped in profile. The protruding part 24 has holes 26 for securing the guitar strings 6. The baseplate 12 is secured to the body of the guitar 2 by means of screws 28 which pass through holes 30 and into the guitar body. It is thus seen that the baseplate may be easily secured to the guitar body, providing a solid base for holding the guitar strings taut.

The saddle 14 comprises a generally flat portion 32 and a protruding portion 34. The protruding portion has grooves 36 for receiving strings 6 and for providing a nodal point for each of the vibrating strings. As may be seen in FIGS. 2 and 5 the protruding portion 34 may comprise two portions 38 and 40 which provide for different spacings from the nut of the guitar for each of the strings, so as to allow the individual strings to each have different lengths. The saddle includes grooves 18 which extend in the direction of the strings. The baseplate 12 is secured to the saddle 14 by means of screws 16 which pass through slots 18 in the saddle and into threaded portions 20 in the baseplate. The saddle 14 is adjustable with respect to the baseplate 12 in the direction of the guitar strings 6.

Baseplate 12 and saddle 14 are provided with gripping means 42 for increasing the sliding resistance of the two elements and for aiding the screws in securing the baseplate to the saddle. The gripping means on the baseplate 12 is shown in FIGS. 2 and 5, and FIG. 4 shows the underside of the saddle 14 showing gripping means 42 thereon.

Thus it may be seen that the structure of the invention provides for a bridge for a stringed instrument made of two elements adjustable with respect to each other, and where each of the elements may be economically manufactured. The saddle of the inventive bridge provides for individual lengths for each of the strings and for easy adjustment of this length. Thus an economical and easily adjusted bridge has been shown and described.

What is claimed:

1. An adjustable bridge for a stringed musical instrument comprising:

a baseplate including a first generally flat part adapted to be secured to the body of said instrument, and a second part integral with said first part and extending outwardly from said first part, and adapted to receive strings for said instrument, and a saddle, consisting of a single element having a first generally flat portion adapted to be secured to said first part of said baseplate, and a second portion integral with said first portion, and projecting from an edge of said first portion and adapted to act as a nodal point for said strings.

2. A bridge as in claim 1, wherein said saddle is adapted to be moved with respect to said baseplate in a direction parallel to a string extending from said baseplate to said saddle.

3. A bridge as in claim 2, wherein said first portion of said saddle has at least one slot therein which extends along said direction, and further comprising means extending through said slot for securing said saddle to said baseplate.

4. The bridge of claim 3, wherein said first part of said baseplate and said first portion of said saddle each have a gripping means, said gripping means on said baseplate mating with said gripping means on said saddle, for increasing sliding resistance between said baseplate and said saddle.

5. The bridge of claim 4, wherein said baseplate is L-shaped and said first and said second parts are generally flat and said second part extends at an angle to said first part.

6. The bridge of claim 4, wherein each of said gripping means comprises protrusions which extend from said baseplate and said saddle respectively.

7. The bridge of any one of the preceeding claims wherein said second portion of said saddle comprises a lip which extends substantially across said saddle, an edge of said lip remote from said first portion being adapted to provide nodal points for said strings.

8. The bridge of claim 7, wherein said lip is shaped to provide a length from the nut of said instrument to said lip for at least one of said strings which is different from said length for another of said strings.

9. The bridge of claim 8, wherein said lip has two spaced, linear portions, each of said portions having grooves for receiving said strings.

10. The bridge of claim 9, wherein said second part of said baseplate has a plurality of holes, each for receiving a guitar string.

* * * * *